United States Patent [19]

Jeltema

[11] 4,440,105

[45] Apr. 3, 1984

[54] PAPER COATING APPARATUS HAVING A REPLACEABLE ORIFICE PLATE

[75] Inventor: Paul A. Jeltema, Wisconsin Rapids, Wis.

[73] Assignee: Consolidated Papers, Inc., Wisconsin Rapids, Wis.

[21] Appl. No.: 458,437

[22] Filed: Jan. 17, 1983

[51] Int. Cl.[3] ..... B05C 3/18

[52] U.S. Cl. ..... 118/410; 118/413

[58] Field of Search ..... 118/407, 410, 413, 259; 427/356, 358

[56] References Cited

U.S. PATENT DOCUMENTS

| | | | |
|---|---|---|---|
| 3,255,038 | 6/1966 | Coghill | 427/356 |
| 4,028,081 | 6/1977 | Marcatili | 65/3.11 X |
| 4,250,211 | 2/1981 | Damrau et al. | 118/413 X |
| 4,308,045 | 12/1981 | Miller | 65/3.11 |

*Primary Examiner*—John P. McIntosh

*Attorney, Agent, or Firm*—Gary, Juettner & Pyle

[57] ABSTRACT

An applicator for applying a coating liquid to a moving web of paper carried through an application zone, wherein the applicator has a chamber for receiving the coating liquid and an opening thereto for directing the liquid into an application zone and onto the web, the zone being established between a front wall of the chamber and a doctor blade extending from a rear side of the opening across and against the web, is characterized by a readily removable and replaceable orifice plate on the front wall, which extends toward and closely spaced from the web to define with the web a gap through which coating liquid in the zone flows to form a liquid seal. Because the orifice plate may readily be removed and replaced, orifice plates of different heights may be used with the applicator, so that simply by selecting a particular orifice plate for use, the gap in which the liquid seal is established may be made to have a predetermined size.

6 Claims, 2 Drawing Figures

PAPER COATING APPARATUS HAVING A REPLACEABLE ORIFICE PLATE

BACKGROUND OF THE INVENTION

The present invention relates to apparatus for coating a moving web of paper, and in particular to an improved short dwell time applicator having a replaceable orifice plate.

Conventional applicators of the trailing blade type include means for applying coating material to a paper web that is usually supported and carried by a resilient backing roll. Such applicators may include a chamber having an opening extending across and parallel to the web, together with a doctor blade located on a trailing side of the opening, which serves to meter and level the coating, and a front wall extending from a leading side of the opening toward the web. Means are provided for supplying a coating liquid to the chamber, and thence through the chamber opening and into an application zone between the front wall and doctor blade and onto the web. To seal the end spaces between the front wall and doctor blade to prevent escape of coating material laterally of the web, edge dam means are provided thereat.

In recent years it has become desirable to produce printed papers having a minimal amount of coating, i.e., on the order of about two or three pounds of coating per ream of paper. In order to achieve low coat weights on conventional trailing blade equipment, it is necessary to increase the pressure of the doctor blade against the web, which results in a high rate of wear on the blade and necessitates more frequent replacement of the blade. High blade pressure also increases the possibility of web breakage and streaking caused by foreign particles being caught between the blade and web.

Many conventional coaters inherently employ a relatively long dwell or soak time, which is the time interval between initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive wet coats without intervening drying because the successive coats tend to migrate into and contaminate the previous coat.

To overcome the disadvantages of prior applicators and produce printed papers having a minimal amount of coating, there has recently been developed an improved applicator, as taught in Damrau et al U.S. Pat. No. 4,250,211, assigned to the assignee of the present invention. The applicator disclosed in that patent is commonly referred to as a short dwell time applicator, and utilizes a reservoir of liquid coating material established in an elongate and narrow application zone between a forward liquid coating material seal and a rearward doctor blade. The coating liquid in the zone is maintained under pressure for pressurized application on the web, and after application is almost instantaneously wiped by the doctor blade. The liquid seal closes the forward end of the zone so that a pressure of coating material may be developed therein, and is defined within a gap between an upper end of an orifice plate and the web, the arrangement being such that a copious excess of coating material introduced into the zone flows through and fills the gap to form the seal.

The size of the gap determines the rate of flow of coating material therethrough and therefore the integrity of the liquid seal and the pressure of material in the application zone, and the orifice plate is adjustable in height to control gap size in response to changes in the viscosity of coating material as well as in applicator head angle. The orifice plate is not readily removable from the applicator, so that adjustment of gap size is made by moving the orifice plate toward and away from the web with a screwjack through a series of linkages and cam followers. Such an adjustment technique has proven to be complicated and costly to fabricate, and difficult to maintain.

OBJECTS OF THE INVENTION

An object of the present invention is to provide a short dwell time applicator for pressurized application of coating liquid onto a moving web of paper, wherein a gap between an upper end of an orifice plate and the web at a forward end of the zone, in which a liquid seal is formed, may be adjusted in size without need for complicated and costly mechanisms for raising and lowering the orifice plate.

A further object of the invention is to provide such an applicator, which is constructed to accommodate convenient removal and replacement of orifice plates, whereby the size of the gap may be controlled merely by selecting an appropriately dimensioned orifice plate for use with the applicator.

SUMMARY OF THE INVENTION

In accordance with the present invention, there is provided an improved applicator for applying a coating liquid to a moving web of paper carried through an application zone. The applicator is of the type comprising a body portion defining a chamber therein having an opening thereto extending substantially transversely across the web, a doctor blade extending from a rear side of said chamber opening substantially transversely across and against the web, and an orifice plate at a forward end of said chamber opening extending substantially transversely across and toward but spaced from the web to define a gap between an upper edge thereof and the web. The applicator also includes means for sealing opposite side ends between said doctor blade and orifice plate, said means for sealing, doctor blade and orifice plate defining said application zone therebetween, and means for introducing a copious excess of coating liquid under pressure through said chamber opening and into said application zone to substantially continuously and completely fill said zone and gap and to flow coating liquid through said gap to form a liquid seal therein for pressurized application of coating liquid on the web in said zone, the size of said gap being adjustable to control the flow rate of coating liquid therethrough.

The improvement according to the invention comprises means for releasably mounting said orifice plate on said applicator for convenient removal and replacement thereof without need to disassemble said applicator. Said orifice plate has a length sufficient to extend substantially across the web and a selected height between said upper edge and a lower edge thereof, and said mounting means includes a front wall on said body portion extending substantially across the web forwardly of said opening, fixed support means on said front wall for supporting said orifice plate with said upper edge thereof extending toward the web and defining said gap therewith, and means for releasably securing said orifice plate to said front wall when the same is supported by said support means. By virtue of said means for releasably securing, the size of said gap may readily be controlled by replacing on said applicator one orifice plate having a first height with another orifice plate having a second and different height.

The foregoing and other objects, advantages and features of the invention will become apparent upon a consideration of the following detailed description, when taken in conjunction with the accompanying drawings.

DETAILED DESCRIPTION

Figure 1:
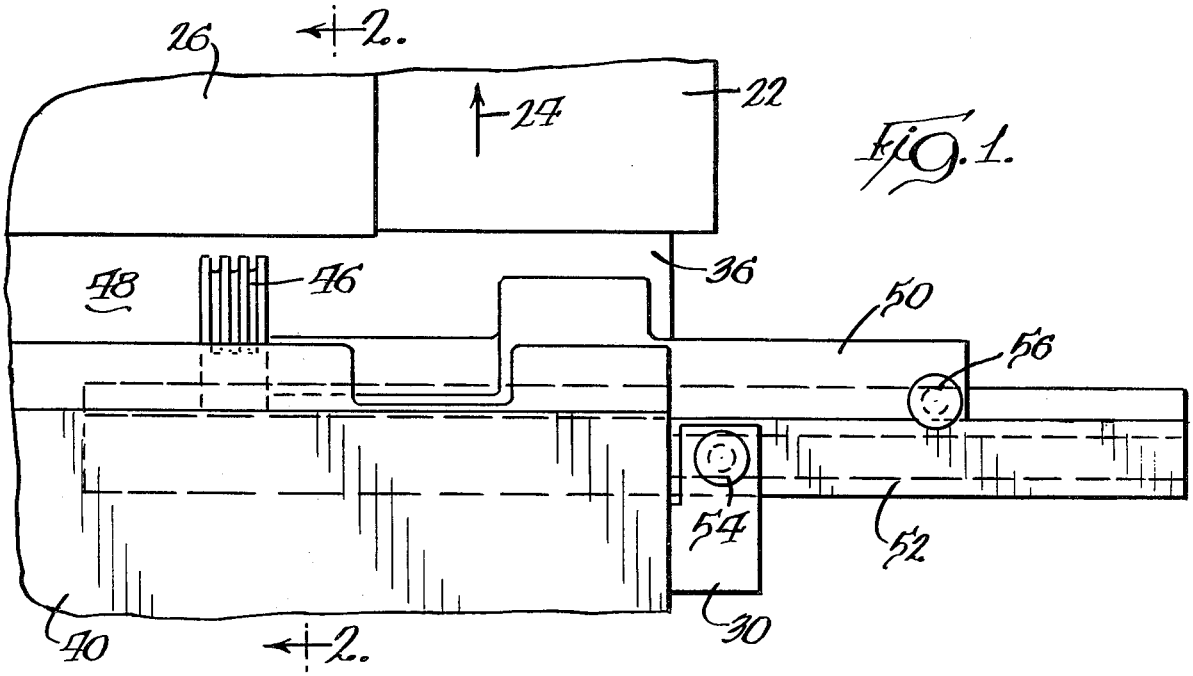
FIG. 1 is a front elevation view of one side end of an applicator of a type with which the teachings of the present invention may advantageously be employed, illustrating a web being carried on a backing roll through an application zone and an edge seal for sealing a side end of the zone.
Figure 2:
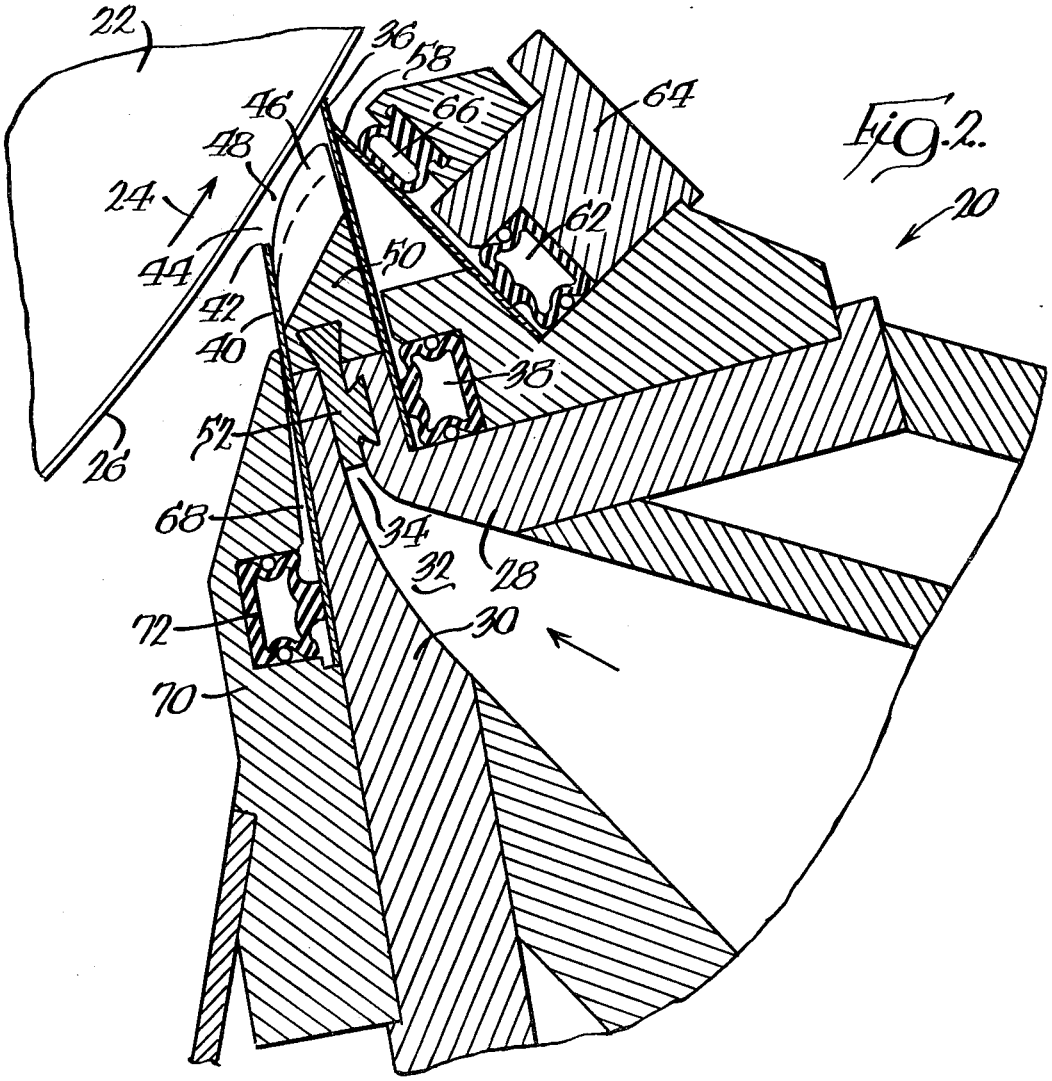
FIG. 2 is a cross sectional side elevation view taken substantially along the lines 2—2 of FIG. 1, showing an arrangement for replaceably mounting an orifice plate on the applicator in accordance with the teachings of the invention.

Referring to the drawings, there is shown an applicator portion of a short dwell time applicator or paper coating machine, constructed in accordance with the teachings of the invention to permit convenient and rapid replacement of an orifice plate thereon. The applicator comprises a main beam, indicated generally at 20, extending parallel to and coextensively with a moving support or backing roll 22, which rotates in the direction shown by an arrow 24 and supports a web of paper 26 during its travel through the applicator. The beam has walls 28 and 30 forming a chamber 32 therebetween for reception of liquid coating material under pressure from a source of material (not shown), and the front and rear walls 30 and 28 converge upwardly toward one another and define a metering slot 34 which extends upwardly adjacent to and facing the web supporting surface of the roll 22. Although not shown, the front wall is pivotally mounted relative to the rear wall to permit the chamber 32 to be opened for cleaning, and also to adjust the width of the metering slot 34.

A flexible doctor or coater blade 36 is held against a rearward surface of the wall 28 by a pneumatic tube 38 which is expandable by the introduction of fluid under pressure therein to press against the blade. The doctor blade extends beyond the metering slot 34 into engagement with the web of paper supported on the roll and serves to meter and level the coating applied on the surface of the web.

The front wall 30 supports an orifice plate 40 which extends beyond the metering slot and converges toward the roll supported web and the doctor blade. The orifice plate has a free edge 42 which is juxtaposed to but slightly spaced from the web, such that a space or gap 44 between the edge and the web is relatively small and less than one inch.

At the two ends of the coater, the spaces between the doctor blade 36 and the orifice plate 40 are sealed off by flexible end dams or edge seals 46 which sealingly engage the upper edges of the walls 28 and 30, the blade and orifice plate, and closely approach the roll supported web 26, thereby to define a coating material application zone downstream from the chamber 32 and the metering slot 34. The end dams 46 may advantageously be of the type as disclosed in Damrau U.S. Pat. No. 4,327,662, the teachings of which are specifically incorporated herein by reference, and are carried at an end of an elongate body 50. To support the body, an internal orifice deckle 52 is dovetailed with an inner surface of the wall 28 at each side end of the metering slot 34, and the body is in turn dovetailed with the deckle. The arrangement is such that the deckle and body may be slidingly moved independently of each other transversely of the application zone. Thus, the deckle may be extended into and block off a selected amount of the side portion of the metering slot, thereby to prevent direct impingement of coating liquid against the end dam, and the body 50 may be moved along the deckle to position the end dam with respect to an edge of the web, whereby an uncoated margin may be maintained along the edge of the web. Thumb screws 54 and 56 are provided to secure the deckle and body against movement once the same are adjusted.

The doctor blade 36 is urged or loaded against the roll support web 26, and meters and levels the desired coating film onto the web. To load the doctor blade, a loading blade 58 is seated at its lower end against a wall 60 of the coater main beam and is held against the wall by an inflatable pneumatic tube 62 extending along and within a loading blade housing 64 mounted on the main beam 20. To urge the loading blade against the doctor blade to load the same, a second pneumatic tube 66 at an upper end of the housing is inflatable to engage the loading blade with a selected force determined by the pressure of fluid within the tube. While for the purpose of simplifying the drawing the loading blade housing is illustrated as being mounted in fixed angular relationship to the main beam 20, it is to be understood that, although not shown, a suitable adjusting means may be provided to vary the angular relationship of the housing with respect to the main beam, and therefore the angle of the loading blade with respect to the doctor blade.

In operation of the applicator, coating liquid is supplied under sufficient pressure and in sufficient quantity to completely fill the chamber 32, the metering slot 34 and the application zone 48 defined by the doctor blade 36, the orifice plate 40 and the end dams 46, to cause a continuous, copious flow of coating material reversely of the direction of web travel through the narrow space or gap 44 defined between the upper edge 42 of the orifice plate and the web. This forms a liquid seal between the edge and the web in a very narrow transverse band under a constant positive pressure. The copious excess of coating liquid that flows through the orifice gap 44 reversely of the direction of web travel forms a non-abrasive liquid seal with the web at the forward edge of the coating application zone (i.e., the application zone 46); causes the coating liquid in the application zone to be maintained under pressure and to be applied to the web under pressure; seals off the forward edge of the application zone against entry of air and foreign matter; strips air from the high speed web and prevents such air from causing streaks or strips in the coating on the web; and causes the doctor blade to doctor the coating liquid while the liquid is held under pressure.

The coating applicator thus far described, except for the doctor blade loading mechanism, is disclosed in detail in U.S. Pat. No. 4,250,211, assigned to the assignee of the present invention, the teachings of which are specifically incorporated herein by reference. For a more specific description of the applicator, reference is made to said patent.

In use of an applicator of the type described, the size of the orifice gap 44 must be controlled, since the gap size determines the amount of coating liquid that will flow therethrough, and therefore the integrity of the liquid seal and the pressure of coating liquid in the application zone 48. Adjustment is required due to variations in the viscosity of coating liquid and because of changes in the angle of the applicator head with respect to the web as may be required for proper coating operations. As disclosed in said U.S. Pat. No. 4,250,211, adjustment of the gap size may be made by controlling the vertical position of the orifice plate, and to that end the plate is moved vertically with a screwjack through a series of linkages and cam followers. However, although the adjustment technique serves the purposes for which it was developed, it has proven to be complicated and costly to fabricate and difficult to maintain.

In improving upon the means described in said U.S. Pat. No. 4,250,211 for controlling the size of the orifice gap, in accordance with the teachings of the invention the orifice plate 40 is not mounted for vertical adjustment on the applicator to move the free edge 42 thereof toward and away from the paper web 26. Instead, it is fixed in position on the applicator, but is readily removable therefrom so that an orifice plate having a selected height, which provides a predetermined spacing of its upper edge from the web, may conveniently be mounted on the applicator. The invention therefore eliminates the need for complicated and costly adjustment mechanisms for the orifice plate.

In particular, the orifice plate 40 is received within and along and seated on the bottom of a relatively narrow and elongate slot or space 68 defined between the front wall and a support member 70 and extending transversely across the coater head. To releasably secure the orifice plate in the slot, and yet permit the same to be readily removed therefrom for replacement, a pneumatic tube 72 within an elongate opening in the support member is inflatable by introduction of fluid therein to press the orifice plate against the wall 30 and hold it in position, or is deflatable to relieve the pressure on the orifice plate so that it may be removed, and a seal is advantageously provided at the upper end of the support member 70 to prevent coating liquid from leaking into the slot.

Because the orifice plate 40 may readily be removed and replaced, it is not necessary that complicated mechanisms be provided to vertically adjust the plate on the applicator to control the size of the gap 44. Instead, upon a change in the angle of the coater head with respect to the web, or in the viscosity of coating liquid, which requires an adjustment of gap size to maintain a proper liquid seal and pressure of coating liquid within the application zone 48, the flow of coating liquid is stopped, the pneumatic tube 72 is deflated and the coater head is retracted from the web. The orifice plate may then be slid transversely out of the slot 68 and replaced with one having a different and selected height or dimension between its lower and upper edges, such that when the new orifice plate is extended into and secured in the slot with its lower edge resting on the bottom of the slot, and the coater head is returned to the operating position, the upper edge of the orifice plate is spaced from the web by an amount which provides the desired gap size. The size of the gap may therefore be controlled very conveniently and economically merely by installing on the applicator an orifice plate having a selected dimension between its lower and upper edges.

While one embodiment of the invention has been described in detail, various modifications and other embodiments thereof may be devised by one skilled in the art without departing from the spirit and scope of the invention, as defined in the appended claims.

What is claimed is:

1. An improved applicator for applying a coating liquid to a moving web of paper carried through an application zone, wherein said applicator is of the type comprising a body portion defining a chamber therein having an elongate opening thereto extending substantially across and parallel to the web, said chamber for receiving coating liquid and directing the same through said opening into an application zone and onto the web; a doctor blade extending from a rear side of said chamber opening substantially across and against the web for metering and leveling coating liquid on the web; an orifice plate extending from a front side of said chamber opening substantially across and toward but spaced from the web to define a gap between an upper edge thereof and the web; seal means at each opposite side end of said doctor blade and orifice plate for sealing the end spaces therebetween, said application zone being defined between said doctor blade, orifice plate and seal means; and means for introducing a copious excess of coating liquid under pressure through said opening and into said application zone to completely fill said zone with coating liquid and to continuously flow coating liquid through said gap to substantially completely and continuously fill said gap with coating liquid to form a liquid seal therein for sealing off the front edge of said application zone, wherein the spacing of said orifice plate upper edge from the web may be controlled to adjust the size of said gap to a selected value, the improvement comprising means for mounting said orifice plate on said applicator for replacement thereof without disassembly of said applicator, said orifice plate being relatively thin and planar, having a length to extend substantially across the web and a selected height between said upper and a lower edge thereof, said mounting means including a front wall on said body portion extending substantially across the web, said front wall having a slot or channel therein extending substantially across the opening toward the web, said orifice plate being transversely extendable into and along said slot from a side end thereof to extend said upper edge thereof out of said slot and toward but spaced from the web to define said gap therewith, and means for releasably securing said orifice plate in said slot, so that to adjust the size of said gap one orifice plate of a first height in said slot may be removed therefrom and another orifice plate of a second and different height may be extended into and releasably secured in said slot, whereby said mounting means permits mounting of orifice blades of selected heights on said applicator to control the size of said gap.

2. An improved applicator as in claim 1, wherein said means for releasably securing comprises pneumatic clamping means.

3. An improved applicator as in claim 1, wherein said means for releasably securing comprises a channel formed in said front wall along and opening into said slot, and an inflatable pneumatic tube in said channel, whereby pneumatic fluid may be introduced into said tube to expand said tube into said slot and against an orifice plate therein, and may be released therefrom to deflate said tube for replacement of one orifice plate of one height with another orifice plate of another height.

4. An improved applicator for applying a coating liquid to a moving web of paper carried through an application zone, wherein the applicator is of the type comprising a body portion defining a chamber therein having an elongate opening thereto extending substantially transversely across the web; a doctor blade extending from a rear side of said chamber opening substantially transversely across and against the web; an orifice plate at a forward end of said chamber opening extending substantially transversely across and toward but spaced from the web to define a gap between an upper edge thereof and the web; means for sealing opposite side ends between said doctor blade and orifice plate, said means for sealing, doctor blade and orifice plate defining said application zone therebetween; and means for introducing a copious excess of coating liquid under pressure through said chamber opening and into said application zone to substantially continuously and completely fill said zone and flow coating liquid through said gap to form a liquid seal in said gap for pressurized application of coating liquid on the web in said zone, wherein the size of said gap is adjustable to a selected size, the improvement comprising means for releasably mounting said orifice plate on said applicator for removal and replacement thereof without need to disassemble said applicator, said orifice plate having a length sufficient to extend substantially across the web and a selected height between said upper and a lower edge thereof, said mounting means including a front wall on said applicator extending substantially across the web forwardly of said chamber opening, support means on said front wall for supporting said orifice plate with said lower edge in fixed position with respect to said front wall and with said upper edge extending toward the web and defining said gap therewith, and means for releasably securing said orifice plate to said front wall support means, whereby the size of said gap may be adjusted by replacing one orifice plate on the applicator and having a first height with another orifice plate having a second and different selected height.

5. An improved applicator as in claim 4, wherein said means for releasably securing comprises pneumatic clamping means.

6. An improved applicator as in claim 5, wherein said pneumatic clamping means comprises a pneumatic tube which is inflatable with fluid to engage and clamp said orifice plate to said support means and deflatable to release said orifice plate from said support means.

* * * * *